US005997802A

United States Patent [19]

Holcombe, Jr. et al.

[11] Patent Number: 5,997,802

[45] Date of Patent: Dec. 7, 1999

[54] DIRECTLY SUSCEPTIBLE, NONCARBON METAL CERAMIC COMPOSITE CRUCIBLE

[75] Inventors: Cressie E. Holcombe, Jr., Farragut; James O. Kiggans, Jr., Oak Ridge; S. Marvin Morrow, Kingston, all of Tenn.; Donald Rexford, Pattersonville, N.Y.

[73] Assignee: The United States of America as represented by the United States Department of Energy, Washington, D.C.

[21] Appl. No.: 09/199,313

[22] Filed: Nov. 25, 1998

Related U.S. Application Data

[60] Provisional application No. 60/066,921, Nov. 28, 1997.

[51] Int. Cl.[6] ..... B22D 41/00

[52] U.S. Cl. ..... 266/275; 266/280; 373/156; 432/262

[58] Field of Search ..... 266/275, 280, 266/242; 432/262; 373/155, 156, 157

[56] References Cited

U.S. PATENT DOCUMENTS

| | | | |
|---|---|---|---|
| 1,871,159 | 5/1932 | Davis et al | 373/155 |
| 3,751,571 | 8/1973 | Burrows | 373/155 |
| 4,160,796 | 7/1979 | Lirones | 266/275 |
| 4,406,699 | 9/1983 | Beck et al. . | |
| 5,333,844 | 8/1994 | Holcombe et al. . | |
| 5,416,795 | 5/1995 | Kaniuk et al. . | |
| 5,482,257 | 1/1996 | Holcombe et al. . | |

*Primary Examiner*—Scott Kastler

*Attorney, Agent, or Firm*—Emily G. Schneider; Stephen D. Hamel; William R. Moser

[57] ABSTRACT

A sintered metal ceramic crucible suitable for high temperature induction melting of reactive metals without appreciable carbon or silicon contamination of the melt. The crucible comprises a cast matrix of a thermally conductive ceramic material; a perforated metal sleeve, which serves as a susceptor for induction heating of the crucible, embedded within the ceramic cast matrix; and a thermal-shock-absorber barrier interposed between the metal sleeve and the ceramic cast matrix to allow for differential thermal expansions between the matrix and the metal sleeve and to act as a thermal-shock-absorber which moderates the effects of rapid changes of sleeve temperature on the matrix.

10 Claims, 3 Drawing Sheets

DIRECTLY SUSCEPTIBLE, NONCARBON METAL CERAMIC COMPOSITE CRUCIBLE

This application claims the benefit of U.S. Provisional Application No. 60/066,921 filed Nov. 28, 1997.

The United States Government has rights to this invention pursuant to Contract No. DE-AC05-96OR22464 with Lockheed Martin Energy Systems, Inc., awarded by the U.S. Department of Energy.

BACKGROUND OF THE INVENTION

This invention relates to a crucible, more particularly to a crucible for high temperature applications.

Currently, graphite crucibles are used to melt high purity reactive metals with high melting points, such as uranium, via vacuum or inert induction heating. However, because the carbon in the crucible contaminates the reactive metal, the graphite must be painted with protective layers of ceramics to slow the infusion of carbon into the metal. In addition, large non-graphite crucibles, such as those formed of silica, used for melting high melting point materials have a tendency to crack during the melt-casting process because of excessive mechanical stresses that develop within the crucible due to nonuniform heating of the crucible. Accordingly, a need in the art exists for a crucible that can be induction heated without cracking and allow for high temperature melting of reactive metals without appreciable carbon contamination.

SUMMARY OF THE INVENTION

In view of the above need, it is object of this invention to provide a crucible that can be induction heated without cracking.

Another object of this invention is to provide a crucible that can be induction heated and allow for melting of reactive metals without appreciable carbon or silicon contamination of the melt.

Briefly, the present invention is a directly susceptible sintered metal ceramic crucible suitable for high temperature induction melting of reactive metals without appreciable carbon or silicon contamination of the melt. The crucible comprises a cast matrix of a thermally conductive ceramic material; a perforated metal sleeve, which serves as a susceptor for induction heating of the crucible, embedded within the ceramic cast matrix; and a thermal-shock-absorber barrier interposed between the metal sleeve and the ceramic cast matrix to allow for differential thermal expansions between the matrix and the metal sleeve and to act as a thermal-shock-absorber which moderates the effects of rapid changes of sleeve temperature on the matrix.

Additional objects, advantages, and novel features of the invention will be set forth in part in the description which follows, and in part will become apparent to those skilled in the art upon examination of the following or may be learned by the practice of the invention. The objects and advantages may be realized and attained by means of the instrumentalities and combinations particularly pointed out herein and in the appended claims.

BRIEF DESCRIPTION OF THE DRAWINGS

The accompanying drawings, which are incorporated in and form a part of the specification, illustrate preferred embodiments of the invention, and together with the description, serve to explain principles of the invention.

Like reference numbers indicate like identical parts.

DETAILED DESCRIPTION

The present invention is a crucible for use in reactive metal melting or casting, such as for uranium or copper. This sintered metal ceramic crucible suscepts in a standard induction field and heats in a sufficiently uniform matter to avoid thermal stress cracking. Further, the crucible allows for melting and alloying without introduction of appreciable carbon or silicon into the melt since there is little apparent reaction between the crucible compositional constituents and the melt, thereby maintaining purity levels at or below precasting levels. In addition, the crucible of the present invention is operable at operating temperatures greater than or equal to 1450° C. in a vacuum or inert atmosphere to insure homogeneity and eliminate prealloying. The crucible also provides a reliable and economic system that is compatible with existing induction heating facilities.

Figure 2A:
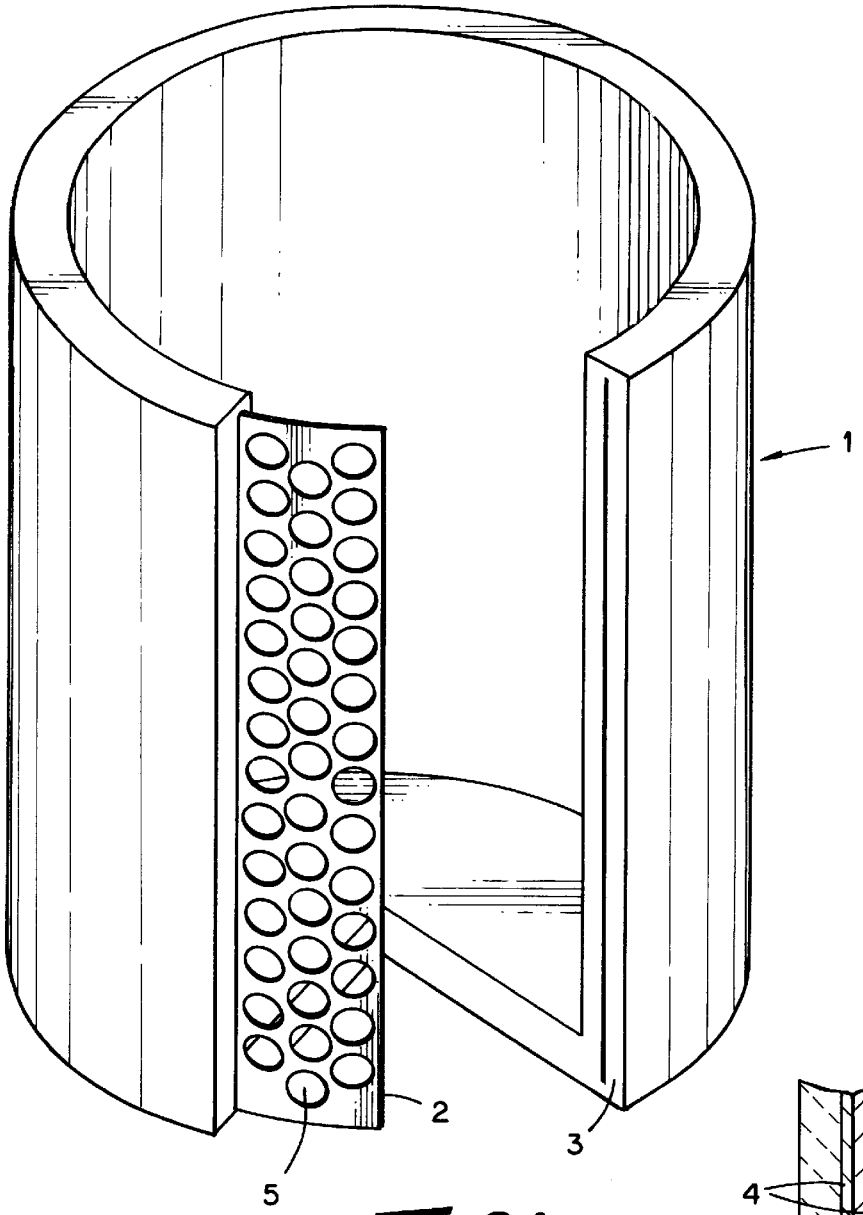
FIGS. 2A-2B, are perspective cut aways of a one-piece cylindrical crucible.
Figure 2B:
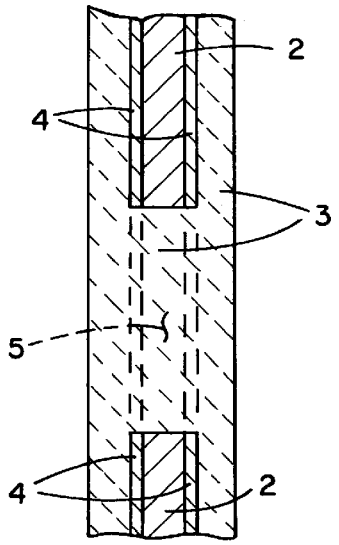

Referring now to FIGS. 2A and 2B, induction heating of the crucible 1 is made possible by the incorporation of a embedded perforated metal sleeve 2 within the ceramic matrix 3 of the crucible. The metal sleeve is preferably formed of molybdenum. As shown, the metal sleeve is perforated with holes 5, similar to a colander used in a kitchen to facilitate passage of matrix material through the colander wall and strengthening the crucible. Once formed, the metal sleeve is first encased in a friable, high alumina mix coating 4 and the coated metal sleeve is then cast inside a high-silicon-carbide formulation matrix 3 followed by sintering.

Figure 1C:
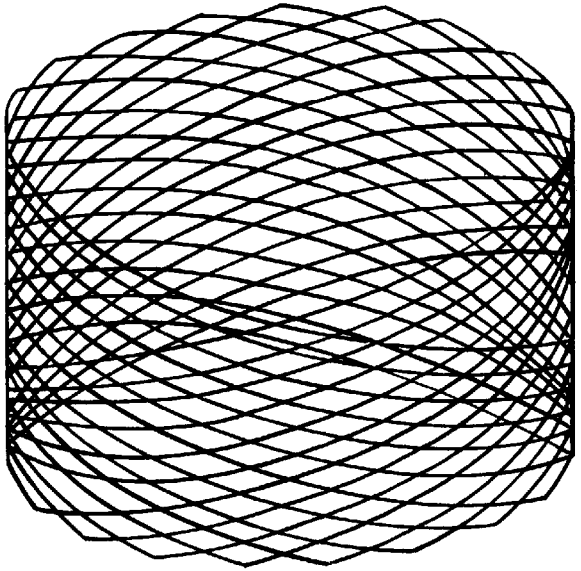
FIGS. 1A-1B and 1C, are schematic diagrams of three different versions of the embedded metal sleeves.
Figure 1B:
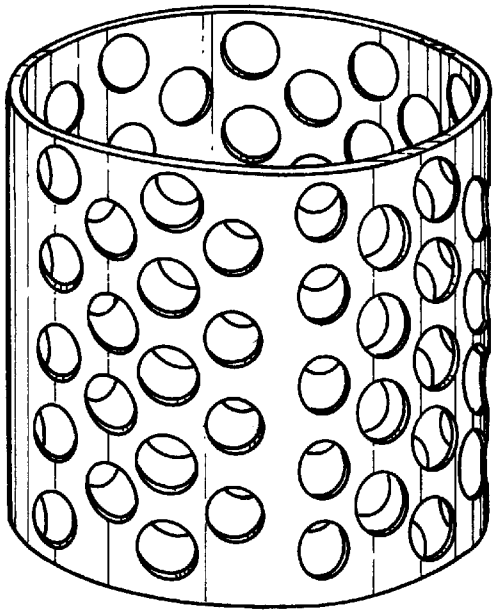
Figure 1A:
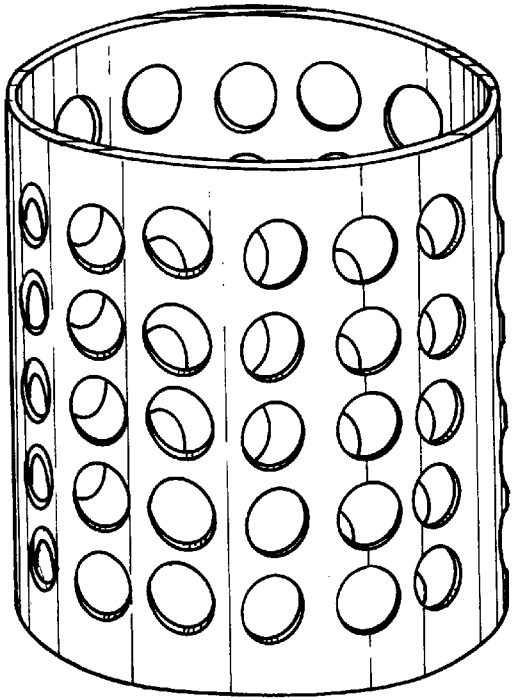

As stated, the embedded metal sleeve is preferably formed of molybdenum and is perforated. The holes 5 of the metal sleeve should be large enough for the coarse grains of the above ceramic cast matrix (up to ⅛ inch grog aggregates) to flow through. Thus, the holes preferably have a diameter in the range of about ⅝ to ¾ inches. The hole configuration and pattern may vary also. For example, the milled square design of FIG. 1A or hexagonal design of FIG. 1B may be used . In another variation, the metal sleeve would be in the form of an expanded corrugated design (FIG. 1C). The thickness of the metal sleeve would depend on the practical limitation of the metal being used. For molybdenum the range of thickness would be in the range of from about 0.031 inches to about 0.125 inches, and preferably from about 0.040 to 0.088 inches. Other compositions may also be used for the metal sleeve such as nitrided TRIBOCOR (Surface Alloys Inc., North Chicago, Ill.), a commercial alloy of composition 50% wt. Niobium, 30% titanium and 20% tungsten that is nitrided at high temperatures (i.e., over 1600° C.) in order to develop a titanium nitride surface. As the crucible is penetrated by puncturing or abrasion over time, the nitrided TRIBOCOR would be much more resistant to molten reactive metal and provide improved stability.

As stated, the friable alumina mix coating 4 on the metal sleeve 2 allows for the differential thermal expansions of the metal sleeve 2 and the ceramic cast matrix 3 during each heating cycle and also acts as a "shock absorber" for the thermal differentials. Also, the alumina in the coating does not react with the molybdenum in the sleeve and acts as a barrier preventing the silicon carbide contained in the ceramic cast matrix from interacting with the molybdenum as well. Other materials could be used instead of alumina such as a titanium or aluminum nitride coating since TiN does not react with the silicon carbide in the matrix formulation or with the molybdenum. This coating is prepared and applied to the metal sleeve via the process disclosed in the following examples.

The ceramic cast matrix used to embed the alumina coated metal sleeve is a high silicon carbide formulation (67.5 wt. % silicon carbide, 29.4% alumina, and 3.7% silica). The cast ceramic matrix is formed around the colander using the "freeze-cast" technology disclosed in U.S. Pat. No. 4,246,209, issued Jan. 20, 1981 to Smith-Johannsen, U.S. Pat. No. 4,369,151 issued Jan. 18,1983 to Smith-Johannsen, and U.S. Pat. No. 4,569,920, issued Feb. 11, 1986 to Smith-Johannsen, assigned to Blasch Precision Ceramics, Inc., Schenectady, N.Y., which are incorporated herein by reference. Other high-thermal conduction ceramics which could be added to the ceramic cast matrix other than silicon carbide include titanium nitride, aluminum nitride, or boron nitride. Titanium nitride, either as pure material or as ground and sized nitrided TRIBOCOR or TRIBOCOR scrap chips, could be substituted for silicon carbide particularly when temperatures exceed 1400° C. in order to avoid the oxide plus silicon carbide reactions that occur in a vacuum, leading to silicon monoxide and carbon monoxide evolution. Also, other thermally conductive additions which could be used in the ceramic cast matrix include refractory metal additions such as granules of niobium, molybdenum, or tungsten, or refractory borides, carbides, or nitrides.

Once cast, the crucibles are then sintered using standard sintering techniques as set forth below.

EXAMPLES

The following examples are given to illustrate the method of the present invention and are not to be taken as limiting the scope of the invention which is defined herein and in the appended claims.

Example 1

Two smaller crucibles (6 in. OD×5 in. ID×8 in. H) were made as follows: First, two molybdenum metal sleeves having a colander-like configuration were prepared. The first metal sleeve consisted of 0.088-inch thick molybdenum measuring 5.3 inch OD×5 inch H that included a hexagonal-design hole pattern with electrical-discharge-machined (EDM) holes and was heli-arc welded. The second metal sleeve was made from 0.062 inch thick molybdenum and measured 5.3 inch OD×6 inch H that included a milled square-design hole pattern (as in FIG. 1A) that was electron beam (EB) welded. The metal sleeves were then shipped to Blasch Precision Ceramics, Inc. of Schenectady, N.Y., where they were encased in a thermal-shock-absorber barrier comprising a friable high-alumina mix coating.

The friable alumina mix was made by combining Calcined Alumina approximately as follows (wt. percents): 16% 100/200, 40% −200, 26% A-10, 13% A-3000 and 8% A-100 with Dupont Ludox colloidal silica (10–15% by weight) and Lithium Polysilicate (2–4% by weight) to produce a material that had the consistency of masonry paint. The mix was applied to all of the surfaces of the metal sleeve, including the edges and surfaces of the holes, with a paint brush to form a coating at least 1/16 inch thick. After the coating was applied, it was allowed to air dry until firm and could be handled without damage. The sleeve was recoated in areas to insure uniform thickness of about 1/16 inch.

The coated metal sleeves were then cast inside the ceramic cast matrix to form the crucibles (6 inch OD×5 inch ID×8 inch H) using the method of U.S. Pat. No. 4,246,209, issued Jan. 20, 1981 to Smith-Johannsen, U.S. Pat. No. 4,369,151 issued Jan. 18, 1983 to Smith-Johannsen, and U.S. Pat. No. 4,569,920, issued Feb. 11, 1986 to Smith-Johannsen, assigned to Blasch Precision Ceramics, Inc., Schenectady, N.Y., incorporated herein by reference. Once cast, the crucibles were sintered with heating parameters running at 1.5 C/min heating rate to a 1450° C. "soak" temperature with a 1-h soak. Vacuum was used until 550 to 600° C. and argon was used for the rest of the sintering. Cooldown was 2° C./minute.

Example 2

A 10 inch H×10 inch diameter crucible was made by methods as described in Example 1. The molybdenum metal sleeve measured 9.5 inches in diameter by 11 inches tall by 0.040 inches thick.

Figure 3:
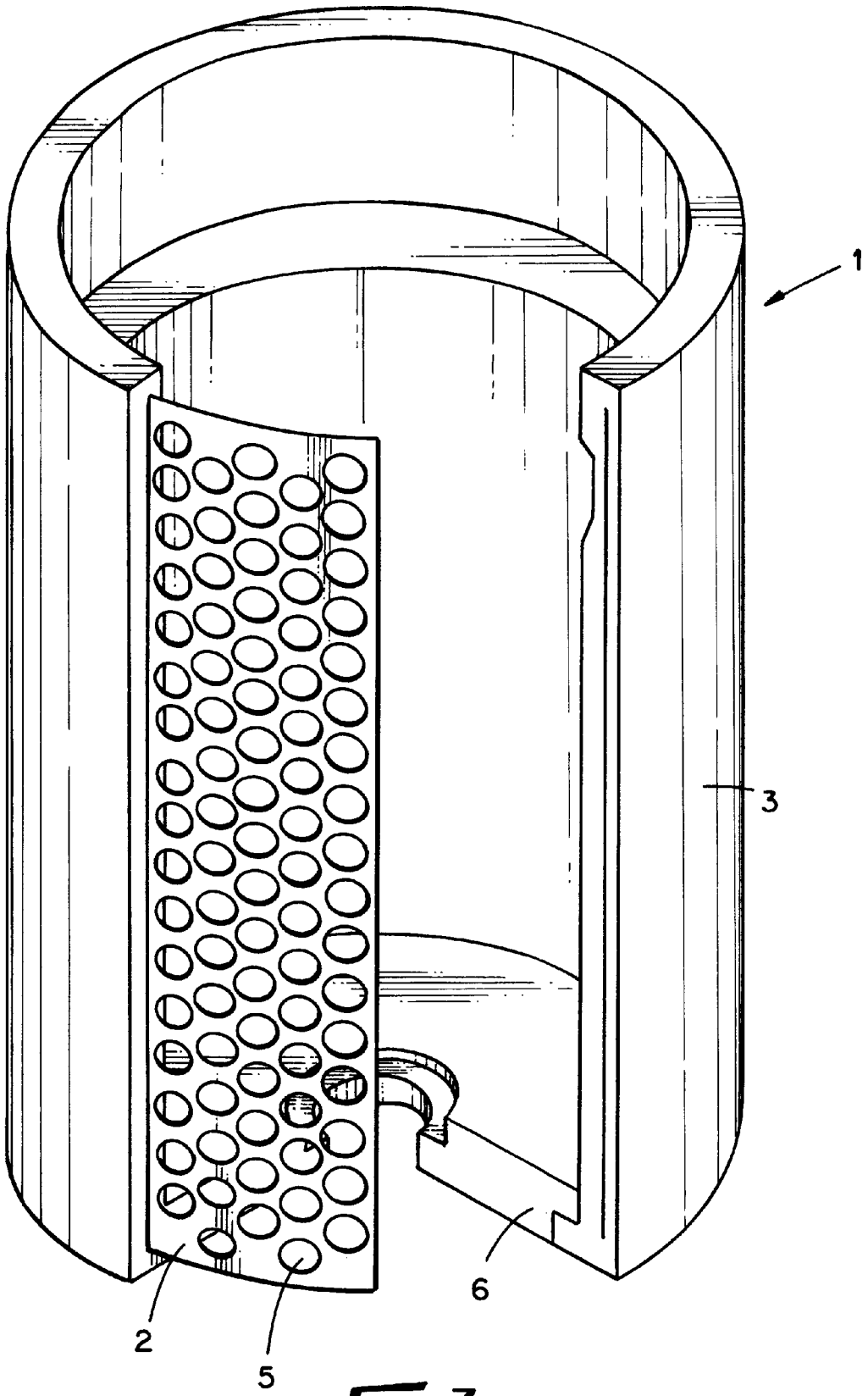
FIG. 3 is a perspective cut away of a cylindrical crucible with a removable end closure.

Induction heating is essential in applications in which the heat of the melt must be maintained during pouring operations. Thus, it is envisioned that the present invention could be handled in an inert atmosphere by a robotic arm and kept hot by induction heating while pouring operations are being undertaken. Side support is not required in the present invention to prevent rupture of the crucible walls as in other ceramic crucibles. The ability to heat the crucible as well as the metal load decreases the thermal gradient across the crucible wall and should lead to a long service life. Furthermore, the crucible of the present invention can be designed in different ways, contain different materials, and have different shapes, depending on the desired high temperature application. For example as shown in FIG. 3, for larger crucibles, the crucible of the present invention may also be in the form of a two piece crucible 1 with a removable end closure 6. Although not separately shown, it is understood that the metal sleeve depicted in FIG. 3 is also coated as described above.

Another variation of the present invention would use a molybdenum encasement instead of an embedded metal sleeve (not shown). The encasement would be on the outside of the ceramic crucible, which has slots. Since the ceramic is heated from the outside to the inside, slotting of the ceramic relieves the stresses that would otherwise be relieved through cracking.

For thicker-walled crucibles, it is also envisioned that two metal sleeves could be embedded, each one such that the holes in the sleeves are offset (not shown). The added metal sleeve would further distribute the heating of the ceramic cast matrix material of the crucible sidewalls.

Thus, it will be seen that a sintered metal ceramic composite crucible suitable for high temperature induction melting of reactive metals without appreciable carbon contamination of the melt has been provided. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A sintered metal-ceramic composite crucible suitable for high temperature vacuum induction melting of reactive metals without appreciable carbon or silicon contamination of the melt comprising:

a) a cast matrix of a thermally-conductive ceramic material;

b) a perforated metal sleeve, which serves as a susceptor for induction heating of said crucible, embedded within said ceramic cast matrix; and c) a thermal-shock-absorber barrier interposed between said metal sleeve and said ceramic cast matrix to allow for differential thermal expansions between said matrix and said metal sleeve and to act as a thermal-shock-absorber which moderates the effects of rapid changes of sleeve temperature on the matrix.

2. The crucible of claim 1 wherein said ceramic cast matrix comprises a mix of silicon carbide, alumina and silica.

3. The crucible of claim 2 wherein said mix comprises, by weight, of about 67.5% silicon carbide, 29.4% alumina and 3.7% silica.

4. The crucible of claim 1 wherein said ceramic cast matrix comprises a mix of titanium nitride, alumina and silica.

5. The crucible of claim 1 wherein said perforated metal sleeve is formed of molybdenum.

6. The crucible of claim 5, wherein said molybdenum has a thickness in the range of from about 0.040 to 0.088 inches.

7. The crucible of claim 1 wherein said thermal-shock-absorber barrier comprises a friable alumina coating on said sleeve.

8. The crucible of claim 1 wherein said crucible has cylindrical sidewalls and a bottom end closure.

9. The crucible of claim 8 wherein said bottom end closure is removable.

10. A sintered metal-ceramic composite crucible suitable for high temperature induction heating of reactive metals without appreciable carbon or silicon contamination of the melt comprising:

a) a ceramic cast matrix comprising a mix, by weight, of about 67.5% silicon carbide, 29.4% alumina and 3.7% silica;

b) a perforated molybdenum sleeve, which serves as a susceptor for induction heating of said crucible, embedded within said matrix; and c) a friable alumina coating on said molybdenum sleeve to allow for differential expansion between said matrix and said sleeve and to serve as a thermal-shock-absorber barrier which moderates the effects of rapid changes in sleeve temperature on said cast matrix.

* * * * *